US007938127B1

(12) United States Patent
Maxwell

(10) Patent No.: US 7,938,127 B1
(45) Date of Patent: May 10, 2011

(54) NAIL POLISH BOTTLE HOLDING DEVICE

(76) Inventor: Mary P. Maxwell, Miami, FL (US)

( * ) Notice: Subject to any disclaimer, the term of this patent is extended or adjusted under 35 U.S.C. 154(b) by 368 days.

(21) Appl. No.: 12/207,328

(22) Filed: Sep. 9, 2008

(51) Int. Cl.
*A45D 29/18* (2006.01)

(52) U.S. Cl. ..... 132/73.5

(58) Field of Classification Search ..... 132/73, 132/73.5, 75, 286, 287, 288
See application file for complete search history.

(56) References Cited

U.S. PATENT DOCUMENTS 1,759,390 A 5/1930 Brandt
2,197,326 A 4/1940 Streyle
2,477,921 A 8/1949 Batton et al.
3,478,763 A * 11/1969 Weinstein ..... 132/75
4,296,766 A 10/1981 Benis
5,913,312 A 6/1999 Donnell
6,349,729 B1 2/2002 Meyer et al.
2005/0002181 A1 1/2005 Chernick et al.

* cited by examiner

*Primary Examiner* — Rachel R Steitz

(57) ABSTRACT

A nail polish bottle holding device for holding bottles of nail polish comprising a base having a top surface and a bottom surface, wherein a plurality of slots and cups are disposed in the top surface of the base. The slots and cups are for holding bottles of nail polish and are light translucent. A plurality of light sources is disposed inside the base, and light from the light sources can penetrate through the slots and cups. A prop is disposed on the top surface of the base. The nail polish bottle holding device of the present invention allows a user to easily see the color of the nail polish in the nail polish bottles.

5 Claims, 3 Drawing Sheets

NAIL POLISH BOTTLE HOLDING DEVICE

FIELD OF THE INVENTION

The present invention is directed to a device for holding bottles of nail polish. More particularly, the present invention is directed to an illuminating nail polish bottle holding device for allowing a user to see the colors of the nail polish inside the nail polish bottles.

BACKGROUND OF THE INVENTION

Many nail polish bottle holders exist currently for storing nail polish bottles. However, it is often difficult for a user to determine the color of the nail polish in the nail polish bottles when they are stored in these nail polish bottle holders. The present invention features a nail polish bottle holding device for holding bottles of nail polish. The nail polish bottle holding device of the present invention comprises a base having a plurality of slots and cups for holding bottles of nail polish. A plurality of light sources is disposed inside the base, and light from the light sources can penetrate through the slots and cups. The nail polish bottle holding device of the present invention allows a user to easily see the color of the nail polish in the nail polish bottles.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
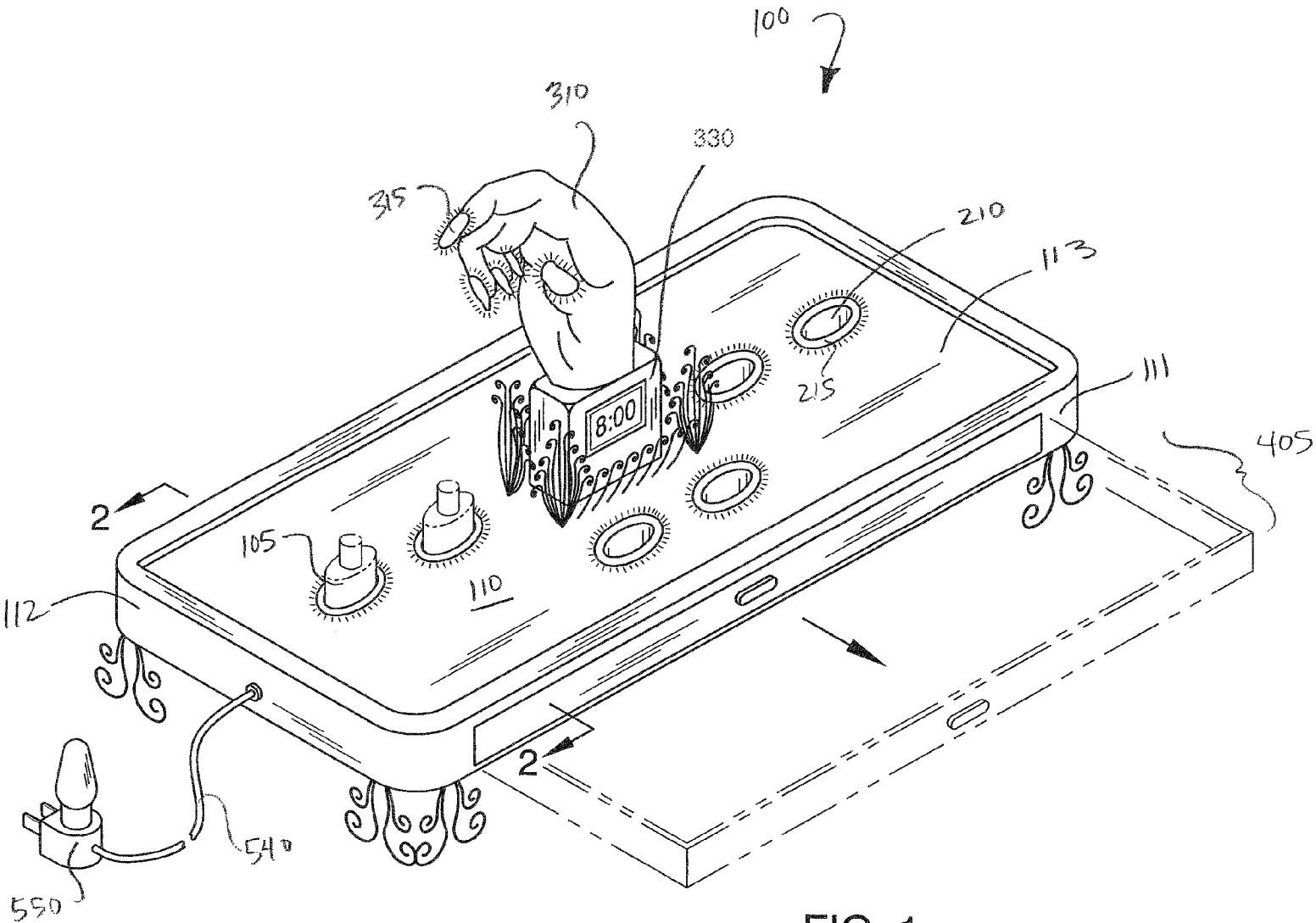
FIG. 1 is a perspective view of the nail polish bottle holding device of the present invention.
Figure 2:
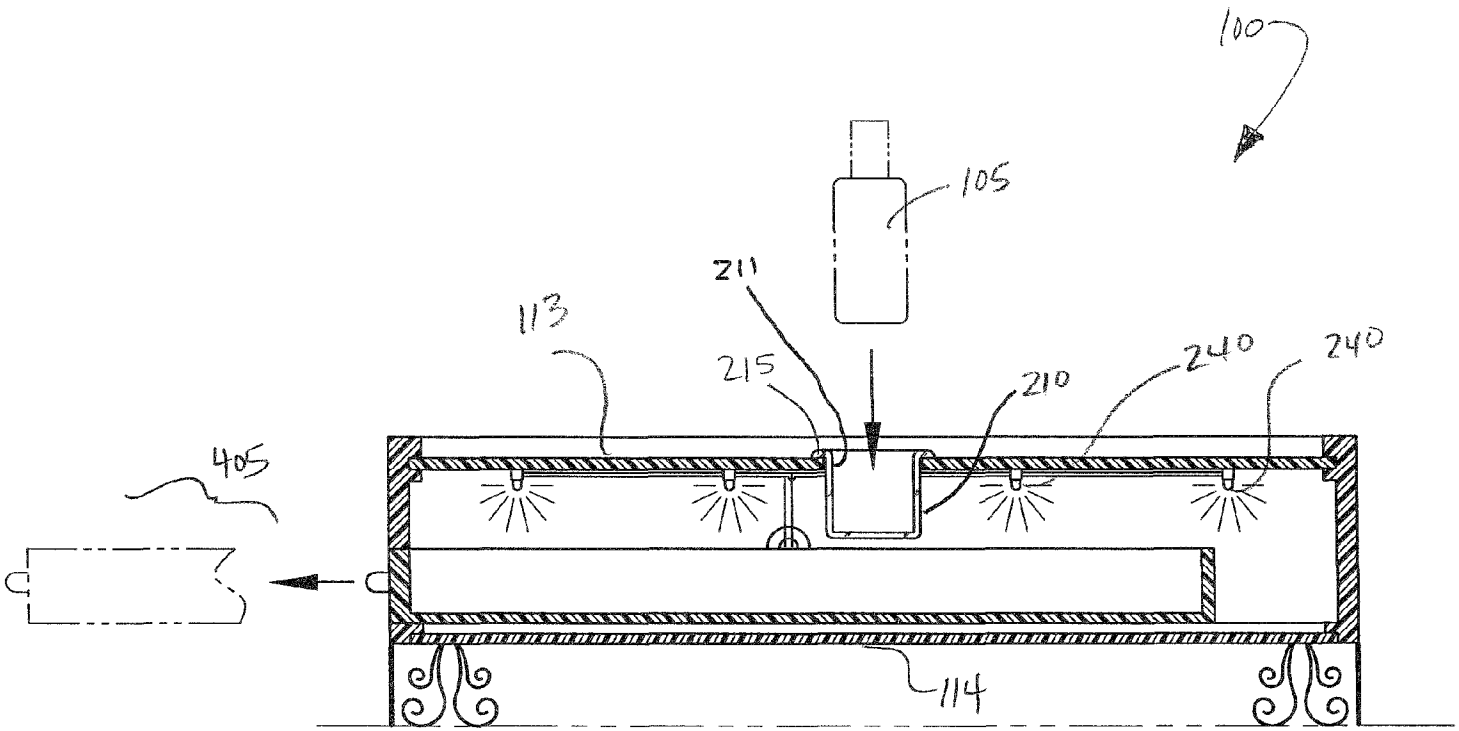
FIG. 2 is a side and cross sectional view of the nail polish bottle holding device of the present invention.
Figure 3:
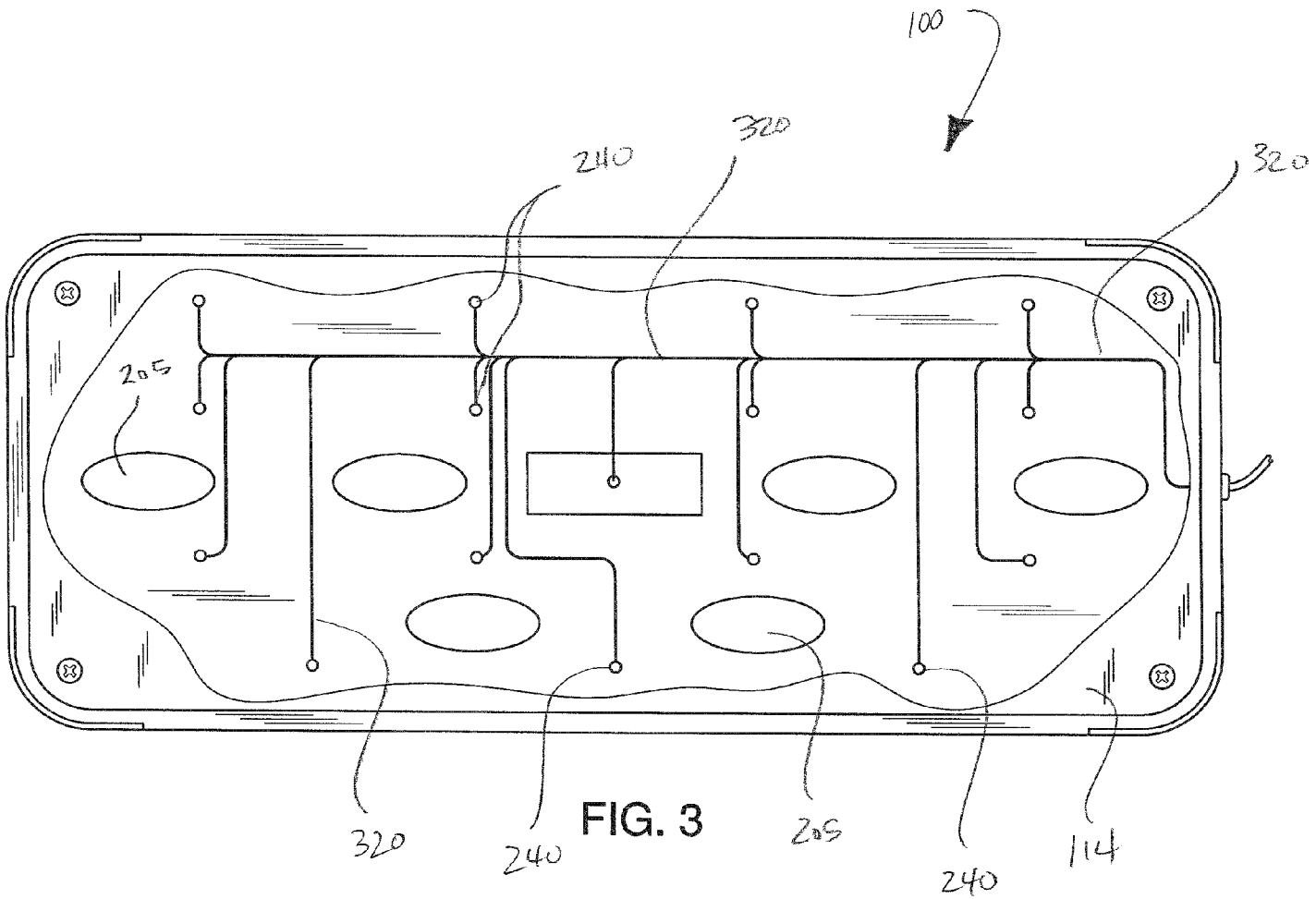
FIG. 3 is a bottom view and internal view of the nail polish bottle holding device of the present invention, including the electrical connections and lights.

The following is a listing of numbers corresponding to a particular element refer to herein:

100 nail polish bottle holding device
105 bottle of nail polish
110 base
111 first side of base
112 second side of base
113 top surface of base
114 bottom surface of base
205 translucent slot
210 cup
215 lip of cup
320 electrical connection
240 light source
310 prop (e.g., mannequin hand)
315 fingernail
330 clock
405 drawer
540 power cord
550 electrical plug Referring now to FIGS. 1-3, the present invention features a nail polish bottle holding device 100 for holding a bottle of nail polish 105. The nail polish bottle holding device 100 comprises a generally flat base 110 having a top surface 113, a bottom surface 114, a hollow inside, a first side 111, and a second side 112. A plurality of slots 205 is disposed in the top surface 113 of the base 110. In some embodiments, the opening area of the slot is sized to snugly fit the neck 211 of the cup 210 that is inserted into the slot 205. The "neck" of a cup is the region of the cup that comes into contact with the top surface 113 of the base 110. The base 110 is not light translucent.

In some embodiments, a drawer 405 is disposed inside the base 110. In some embodiments, the drawer 405 can be slid in and out of the base 110 via the first side 111 of the base 110. In some embodiments, a user can store his/her jewelry or other items in the drawer 405.

Disposed in the slots 205 are translucent cups 210 for holding a bottle of nail polish 105. The cups 210 each have an expanded lip 215 for anchoring to the top surface 113 of the flat base 110. The cups 210 are light translucent. In some embodiments, the cups 210 are constructed from a material comprising a glass.

A light source 240 is disposed in the hollow inside of the base 110. In some embodiments, a plurality of light sources 240 is disposed in the hollow inside of the base 110. The light source 240 can emit a light that penetrates through the translucent cups 210. Without wishing to limit the present invention to any theory or mechanism, it is believed that the nail polish bottle holding device 100 of the present invention is advantageous because the light from the light source 240 shining through the translucent slots 205 and cups 210 helps a user to easily see the color of the nail polish in the nail polish bottle 105. In some embodiments, the light sources 240 are light emitting diodes (LEDs), string lights, light bulbs, the like, or a combination thereof.

The light sources 240 are electrically connected via electrical connections 320 to a power source for illuminating the light from the light sources 240. In some embodiments, the power source is a battery. In some embodiments, a power cord 540 or an electrical plug 550 connects the nail polish bottle holding device 100 to an electrical outlet.

In some embodiments, the nail polish bottle holding device 100 further comprises a prop 310 disposed on the top surface 113 of the base 110. In some embodiments, the prop 310 is a mannequin hand and/or mannequin foot. In some embodiments, the mannequin hand and/or foot comprises fingernails 315 and/or toenails, respectively. In some embodiments, the fingernails 315 and/or toenails can be lit up up via the light sources 240. In some embodiments, the prop 310 comprises a clock 320.

The nail polish bottle holding device 100 of the present invention may be constructed from a variety of materials. For example, in some embodiments, the nail polish bottle holding device 100 may be constructed from a material comprising a glass, a plastic, a metal, the like, or a combination thereof.

In some embodiments, the nail polish bottle holding device 100 may be constructed from a material comprising acrylic materials (e.g., polymethyl methacrylate). In some embodiments, examples of acrylic materials that may be used in accordance with the present invention may be obtained commercially under the name Plexiglas, Limacryl, R-Cast, Perspex, Plazcryl, Acrylex, Acrylite, Acrylplast, Altuglas, Polycast, Lucite, or acrylic glass. In some embodiments, the nail polish bottle holding device 100 is constructed from a materials comprising a polystyrene (PS), polypropylene (PP), low density polyethylene (LDPE), polyvinylchloride (PVC), high density polyethylene (HDPE), polyethylene terephthalate (PET), derivatives thereof, or combinations thereof.

For any embodiment of the present invention, the term "translucent" is interchangeable with the term transparent, semi-translucent, semi-transparent, or semi-opaque. For example, an embodiment of a nail polish bottle holding device comprising a light-translucent cup may be constructed using a light-transparent cup.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A nail polish bottle holding device comprising:

(a) a generally flat base having a top surface, a bottom surface, a hollow inside, a first side, and a second side, wherein a plurality of slots are disposed in the top surface of the base; wherein the base is not light translucent;

(b) a translucent cup for holding a bottle of nail polish disposed in a slot, wherein the cup has an expanded lip for anchoring the cup to the top surface of the flat base, wherein the cup is light translucent;

(c) a light source disposed in the hollow inside of the base, wherein a light emitted from the light source penetrates through the translucent cup; wherein the light facilitates a viewing of the bottle of nail polish disposed in the translucent cup; and (d) a power source connected to the light source for illuminating the light.

2. The nail polish bottle holding device of claim 1, wherein the base further comprises a prop on its top surface.

3. The nail polish bottle holding device of claim 2, wherein the prop is a mannequin hand.

4. The nail polish bottle holding device of claim 2, wherein the prop is a mannequin foot.

5. The nail polish bottle holding device of claim 1, wherein the cup is constructed from a material comprising a glass.

* * * * *